US007232292B2

(12) United States Patent
Lopatinsky et al.

(10) Patent No.: US 7,232,292 B2
(45) Date of Patent: Jun. 19, 2007

(54) INTEGRATED MOTORIZED PUMP

(75) Inventors: Edward L. Lopatinsky, San Diego, CA (US); Dan K. Shaefer, Palm Desert, CA (US); Saveliy T. Rosenfeld, San Diego, CA (US); Lev A. Fedoseyev, El Cajon, CA (US)

(73) Assignee: Rotys Inc., San Diego, CA (US)

( * ) Notice: Subject to any disclaimer, the term of this patent is extended or adjusted under 35 U.S.C. 154(b) by 679 days.

(21) Appl. No.: 10/486,873

(22) PCT Filed: Aug. 20, 2002

(86) PCT No.: PCT/US02/26711

§ 371 (c)(1),
(2), (4) Date: Feb. 12, 2004

(87) PCT Pub. No.: WO03/016718

PCT Pub. Date: Feb. 27, 2003

(65) Prior Publication Data

US 2004/0234399 A1 Nov. 25, 2004

Related U.S. Application Data

(60) Provisional application No. 60/314,016, filed on Aug. 21, 2001.

(51) Int. Cl.
*F04B 17/00* (2006.01)
*F04B 35/04* (2006.01)

(52) U.S. Cl. ..... 417/423.1; 417/423.14

(58) Field of Classification Search ..... 417/423.1, 417/423.14, 423.7; 310/61, 71, 68 R, 98
See application file for complete search history.

(56) References Cited

U.S. PATENT DOCUMENTS

| | | | | |
|---|---|---|---|---|
| 5,007,806 | A | 4/1991 | Bellis et al. | |
| 5,044,897 | A * | 9/1991 | Dorman | 417/423.7 |
| 5,840,070 | A | 11/1998 | Wampler | |
| 6,080,133 | A | 6/2000 | Wampler | |
| 6,232,696 | B1 * | 5/2001 | Kim et al. | 310/156.37 |
| 6,263,957 | B1 | 7/2001 | Chen et al. | |
| 6,280,157 | B1 * | 8/2001 | Cooper | 417/423.7 |
| 6,302,661 | B1 | 10/2001 | Khanwilkar et al. | |
| 2003/0091450 | A1 * | 5/2003 | Davis et al. | 417/423.7 |
| 2005/0121996 | A1 * | 6/2005 | Lopatinsky et al. | 310/268 |
| 2005/0147512 | A1 * | 7/2005 | Chen et al. | 417/423.12 |

* cited by examiner

*Primary Examiner*—William H. Rodríguez

(57) ABSTRACT

An integrated motorized pump (1) comprising an impeller (2) mounted on an axle (3), two magnetic drives (6) electromagnetically coupled to an electric motor (7), a casing (8) with a flowing space (9), an inlet channel (10) and an (11). The impeller (2) has circumferential arrayed magnetic means (13) magnetized in the direction parallel to the axle (3). The electric motor (7) comprising said impeller (2) as a rotor, and two stator plates (20). The stator plates (20) are covered with a liquid tight coating and comprise circumferential arrayed coils (21) etched on circuit board metal layers (22). Each magnetic drive (6) comprises a stator (14) with circumferential arrayed coil windings (16) and two magnetized disks (15). The magnetized disks (15) are mounted on the axle (3) perpendiculary to it and have a circumferential carry of radially extending poles (17).

21 Claims, 15 Drawing Sheets

TRASPARENT VIEW

INTEGRATED MOTORIZED PUMP

CROSS REFERENCE TO RELATED APPLICATIONS

This application is a U.S. National Phase Application under 35 USC 371 of International Application PCT/U502/026711 filed Aug. 20, 2002 which claims the benefit of priority of U.S. Provisional Patent Application Ser. No. 60/314,016, filed Aug. 21, 2001.

FIELD OF THE INVENTION

The invention covered by this application is related generally to magneto electric pumps, in particular, to pumps for liquid cooling, and may be used in the manufacture of liquid pumps for various purposes, e.g. liquid cooling of electronic components, car board pumps, fuel pumps etc.

BACKGROUND OF THE INVENTION

During normal operation many electronic components generate significant amounts of heat. If this heat is not continuously removed, the component may overheat resulting in damage and/or reduction in operating performance. In order to avoid such problems cooling devices are often used in conjunction with these components.

One such cooling device is a fan assisted heat sink. In such a device a heat sink is formed from a material, such as aluminum, which readily conducts heat. The heat sink is usually placed on top of and in physical contact with the component. At some point, however, the amount of heat energy to be dissipated by air coolers exceeds their ability and liquid cooling would apply.

At this point, a liquid cooled heat sink is utilized or a combination of the fan assisted heat sink and the liquid cooled heat sink (see U.S. Pat. No. 6,263,957). A liquid can absorb large amounts of heat energy at low temperature gradients. To produce this type of heat sink for the new generation PC the cooling device must be relatively small. The pump has a separate electrical motor drive in the above mentioned patent, and the sizes of this device are relatively large.

It is known from another prior art (see U.S. Pat. No. 5,007,806), the liquid pump combines the electric motor and pump in a single unit. The sizes of this unit are relative large for use in a liquid cooled heat sink. Also, it is very important to have very reliable motorized pump that would realize the sealless design. In addition, many of existing magnetic driven sealless pumps have slippage capabilities.

It would be desirable to provide a combination of pump/motor for cooling apparatus that would overcome these disadvantages associated with well known devices.

SUMMARY OF THE INVENTION

The objectives of the present invention are to realize an electric integrated combination motor-pump having relatively small dimensions, higher reliability, sealless design and exclude slippages.

In order to achieve these objectives, according to the present invention, an integrated motorized pump, comprises: an impeller that is mounted on an axle and has at least one impeller disk and blades attached to said at least one impeller disk, at least one magnetic drive electro magnetically coupled with an electric motor, and a casing with a flowing space and inlet and outlet channels, wherein: said impeller is placed inside said flowing space and along with said flowing space, inlet and outlet channels forms the pump flowing part; said impeller has circumferential arrayed magnetic means magnetized in the direction parallel to the axle; the magnetic drive comprises at least one stator and at least one magnetized disk, and said stator comprises circumferential arrayed coil windings, and said magnetized disk is mounted on said axle and has a circumferential array of radially extending magnetized poles and is mounted perpendicularly to the axle, the magnetized poles of said magnetized disk is spaced axially from the magnetic means of said impeller to form a gap, and at least part of said magnetized poles of said magnetized disk are magnetically opposite to the magnetic means of the impeller, such that the N flux lines of the magnetized poles of said magnetized disk extends to S poles of the magnetic means of the impeller in the shortest axial flux dimension across said gap; the electric motor comprises said impeller as a rotor and at least one stator plate; the stator plate is covered with a liquid tight coating and has circumferential arrayed coils etched on circuit board metal layers and said coils are at least partially positioned within said gap between said magnetized disk and said magnetic means, and the number of said coils is divisible in respect to the number of said magnetic means and said magnetized poles; the casing is rigidly secured with the axle and the stator plate.

The stator plate of said electric motor may serve as the stator of the magnetic drive.

Further the impeller is a drum type impeller, said flowing space comprises at least one internal channel located inside an array of said blades, the internal channel, the inlet and outlet channels are spaced at a plane perpendicular to the axle, so as liquid flows through the inlet channel, the blades of the impeller, the internal channel, the blades of impeller again and the outlet channel in a series way so that said integrated motorized pump is a cross flow type pump. This cross flow type pump with said internal channel realizes a pump with high pressure at relative low flow rate.

According to second embodiment the impeller may be a radial type impeller, the axle is made like a blind hollow cylinder, said blind hollow cylinder serves as an inlet channel and comprises exit ports through a lateral surface of the blind hollow cylinder, so as liquid flows through the inlet channel, the blind hollow cylinder, the exit ports, the blades of said impeller and the outlet channel in a series way. This integrated motorized pump is a centrifugal type pump.

There is third embodiment when the impeller is a radial type impeller with the blades attached to end surface of the impeller disk; the impeller, the inlet and outlet channels are spaced at a plane perpendicular to said axle, so as liquid flows through the inlet channel, circumferentially with said impeller and through the outlet channel in a series way. This integrated motorized pump is a peripheral type pump according to this embodiment.

The axle may be hermetically secured with the casing and the stator plates so said pump flowing part becomes sealless.

The magnetic means may be at least part of said impeller disk, at least part of said blades or at least part of every said blades.

The coil windings and coils are plated with ferromagnetic coating material and the ferromagnetic coating material is nickel.

The coil windings are etched on the circuit board metal layers and these metal layers are copper layers.

The stator and stator plates further comprises a controlling device of a type H-bridge drive, and a single layer of coil windings located on each side of the circuit board, where each said layer comprises several pairs of coil windings and each pair is made as a spiral that extends from the center of a start coil winding to a center of an end coil winding with the same turn direction of the spiral in relation to each coils center; said layers of coil windings are the same in transparent view and shifted angularly in such a way that the center of the start coil windings from one side of the board are electrically connected through the circuit board by internal via's, which are copper plated holes, with the center of the end coil windings on the other side of the board; the circuit of said one layer of coil windings is interrupted (broken) for providing power leads to the said controlling device.

According to variant of design the magnetic drive comprises two magnetized disks and one stator located between said magnetized disks, and wherein each magnetized disk is mounted on the axle and has a circumferential array of radially extending magnetized poles and is mounted perpendicularly to the axle. The magnetized poles of one magnetized disk is spaced axially from the magnetized poles of other magnetized disk to form a gap. The magnetized poles of one magnetized disk are magnetically opposite to the magnetized poles of other magnetized disk, such that the flux lines of the magnetized N poles of one magnetized disk extends to S poles of other magnetized disk in the shortest axial flux dimension across said gap.

Further, the integrated motorized pump may comprise two magnetic drives and the electric motor comprise two stator plates and the impeller placed between said two stator plates. Each of said two magnetic drives located outside on each side of the electric motor on the axle. At least one stator plate of said electric motor may serves as the stator of the magnetic drive. Both magnetic drives secured on a common shaft placed in the inside opening of the said axle, said shaft at first magnetic drive is hollow and said shaft at second magnetic drive made as a bolt that secures and interlocks both said magnetic drives.

The magnetic drive further has at least one ended ferrous metal plate that is mounted opposite said magnetic drive to said electric motor on said axle for strengthening and alignment of said flux lines in direction to said magnetized disk.

DETAILED DESCRIPTION OF PREFERRED EMBODIMENTS

Preferred embodiments of the present invention will be described in detail below with reference to the accompanying drawings.

Figure 1:
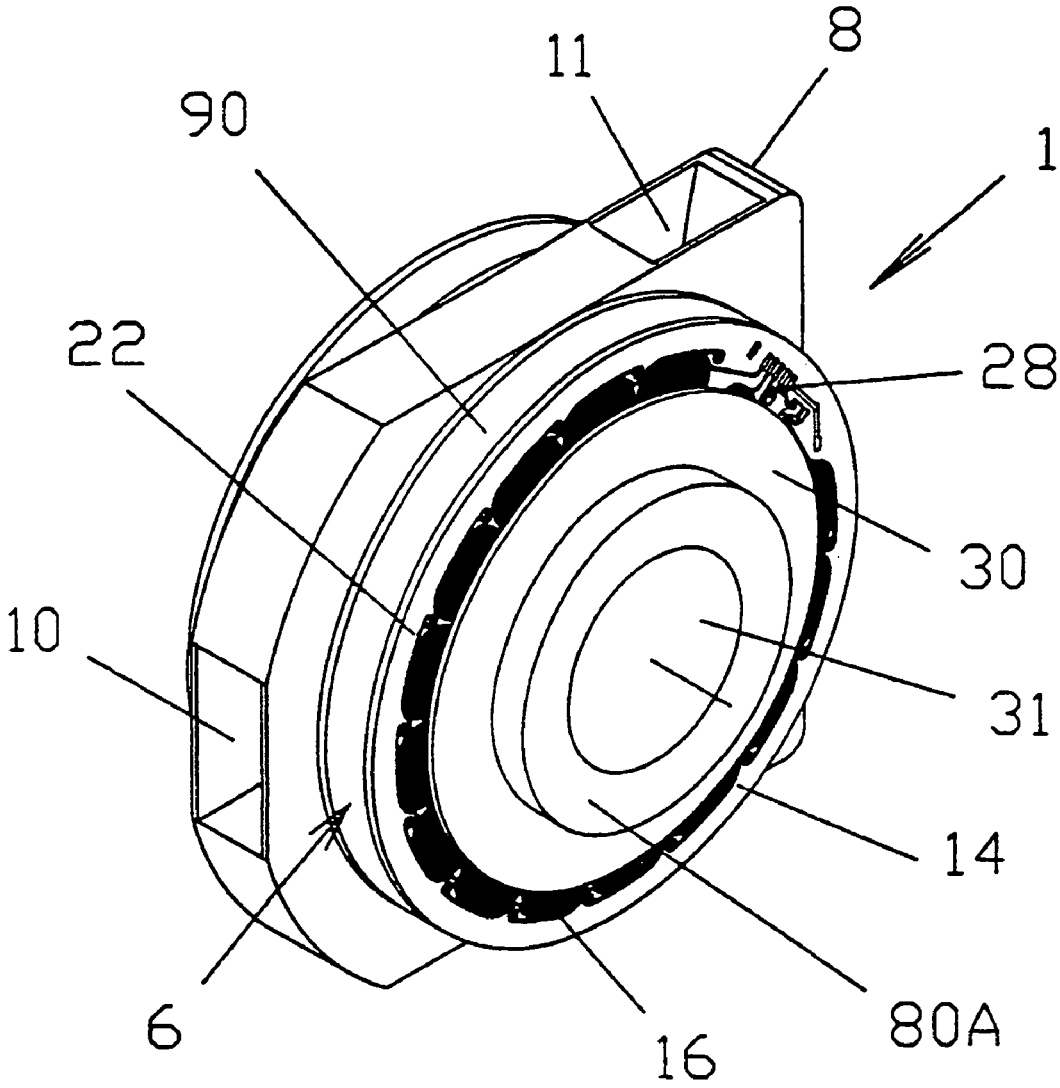
FIG. 1 is a perspective view showing the integrated motorized pump according to present invention when a pump is a cross flow type pump.
Figure 1A:
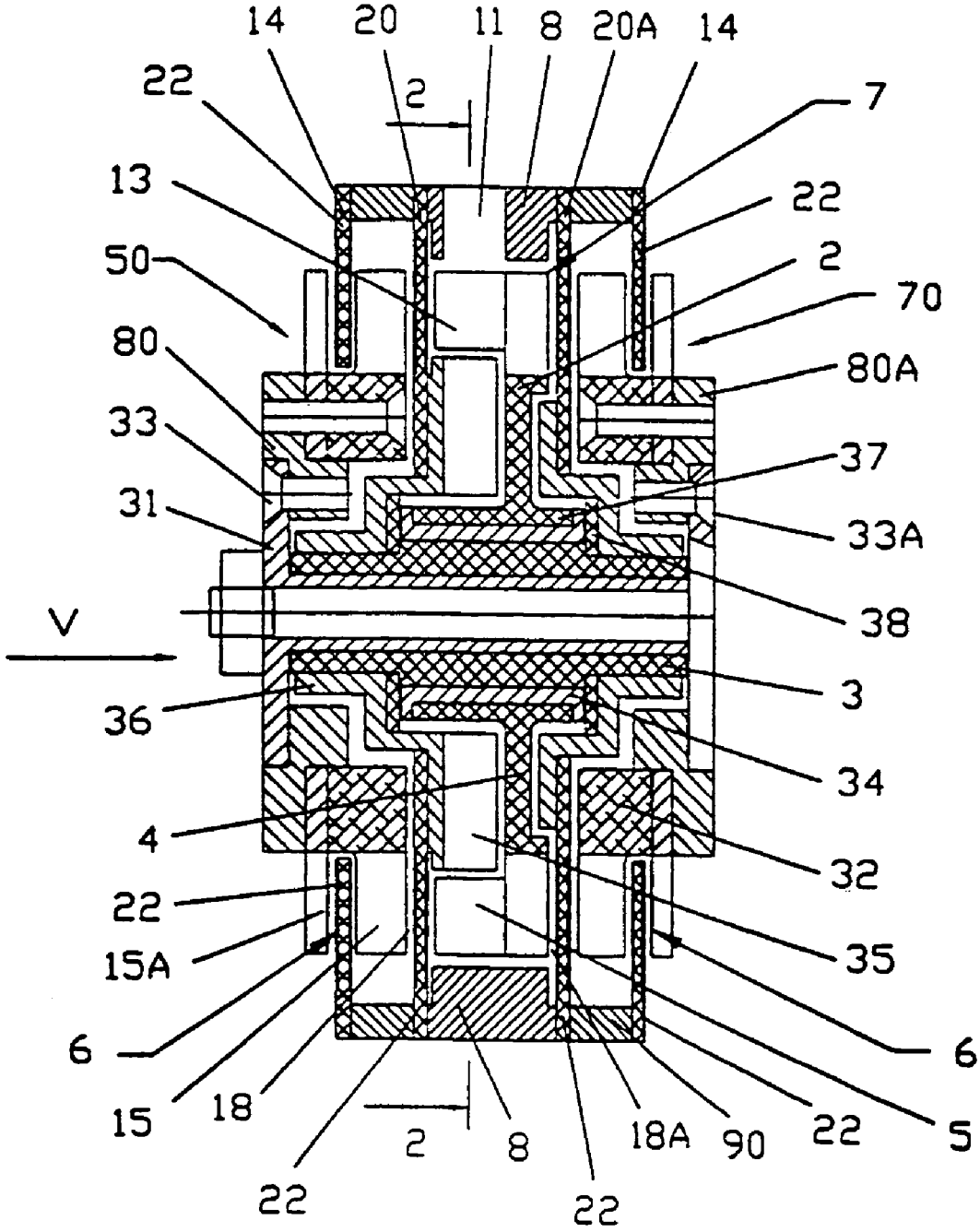
FIG. 1A is an axial cross sectional view of FIG. 1 (without ended ferrous metal plates)
Figure 2:
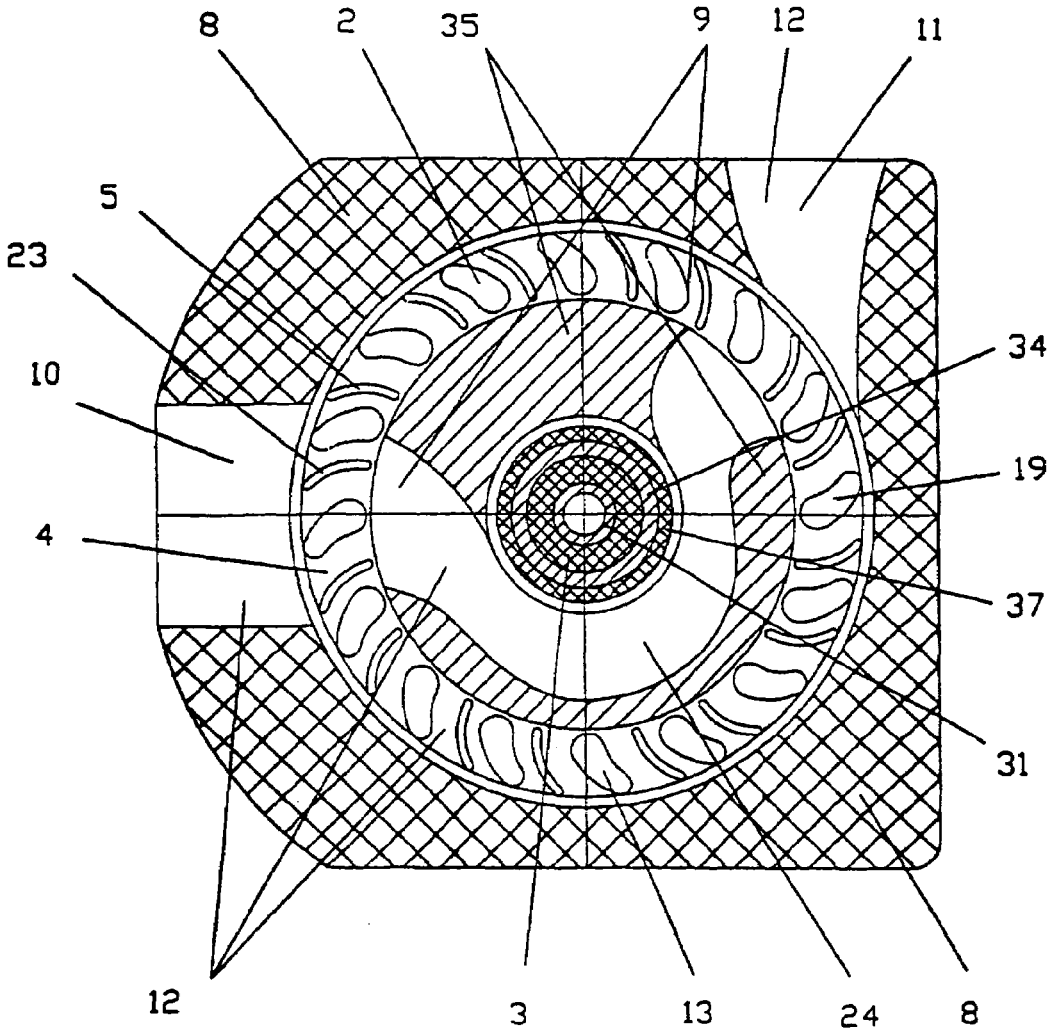
FIG. 2 is a cross sectional view along section 2-2 of FIG. 1A.

An integrated motorized pump 1 (FIGS. 1-3) comprises: an impeller 2 that is mounted on an axle 3, two magnetic drives 6 electro magnetically coupled with an electric motor 7, and a casing 8 with a flowing space 9 and inlet channel 10 and outlet channel 11.

The impeller 2 (FIGS. 1A, 2-4, 7, 10 and 11) may be a different type as will be described further and has one impeller disk 4 and blades 5 attached to the impeller disk 4. The impeller 2 placed inside the casing 8 and along with the flowing space 9, inlet and outlet channels 10 and 11 forms pump flowing part 12. The blades 5 are magnetized in the direction parallel to the axle 3 and serves as circumferential arrayed magnetic means 13.

Each of two magnetic drives 6 (FIGS. 1, 1*a*, 3 and 6) includes one stator 14 and two magnetized disk 15 and 15A. The stator 14 (FIGS. 1, 1A, 3, 6, 8, 10 and 11) comprises circumferential arrayed coil windings 16. The magnetized disks 15 and 15A (FIGS. 1, 1A, 3, 5, 6, 10 and 11) are mounted on the axle 3 perpendicularly to the axle 3 and have a circumferential array of radially extending magnetized poles 17. The stator 14 secured, on the casing 8 and placed between two magnetized disks 15 and 15A spaced from each other in direction parallel to the axle 3. All magnetized poles 17 of magnetized disk 15 are magnetically opposite to adjacent magnetized poles 17A of magnetized disk 15A such that the flux lines of the magnetized N poles 17 of the magnetized disk 15 extends to S poles of the magnetized poles 17A of the magnetized disk 15A in the shortest axial flux dimension.

Each magnetic drive 6 electro magnetically coupled with the electric motor 7 (FIGS. 1A, 3, 4, 7, 10 and 11) comprises impeller 2 with blades 5 as rotor 19 and two stator plates 20 and 20A. The electro magnetic interaction between magnetic drive 6 and electric motor 7 is realized by common electro magnetic field. The blades 5 as magnetic means 13 of the impeller 2 are spaced axially from the magnetized poles 17 and 17A of the magnetized disks 15 and 15A and form gaps 18 and 18A. Magnetized poles 17 of magnetized disks 15 are magnetically opposite to the blades 5 of the impeller 2, such that the flux lines of the magnetized N poles 17 of the magnetized disk 15 extends to S poles of the blades 5 of the impeller 2 in the shortest axial flux dimension across the gaps 18 and 18A. Such this strong electro-magnetic link between electric motor 7 and magnetic drives 6 exclude slippages capabilities of the integrated motorized pump 1.

The stator plates 20 and 20A (FIGS. 1A, 3-5, 7, 8, 10 and 11) of electric motor 7 with circumferential arrayed coils 21 secured on the axle 3 and casing 8 and placed in gaps 18 and 18A. The description of this type of the electric motor may be found in U.S. Provisional Application No. 60/301,229 for the same assignee full text of which is incorporate therein by reference.

The stator plates 20 and 20A are covered with a liquid tight coating from the rotor 19 side and comprises circumferential arrayed coils 21 etched on circuit board metal layers 22. The coils 21 are at least partially positioned within the gaps 18 and 18A between the magnetized disks 15 and 15A and the magnetic means 13. The number of the coils 21 is divisible in respect to the number of the magnetic means 13 and the magnetized poles 17.

FIGS. 1-9 represent the preferred embodiment of the present invention with the cross flow type pump, the electric motor 7 and magnetic drives 6 are integrated as one unit. The electric motor 7 and magnetic drives 6 is of a brushless type motor using disk shaped printed circuits boards 22 of two stator plates 20, 20A and two stators 14 to form a stator part of the electric motor 7 and magnetic drives 6, correspondingly. To allow easer description, the "outer" magnetic drives 6 are shown on FIG. 6 and the "inner" electric motor 7 is shown on FIG. 7. The electronic controlling device 28 (FIGS. 3-5 and 8) for commutating the electric circuits of the stators 14 of the magnetic drives 6 and the stator plates 20 and 20A of electric motor 7 is a Full Bridge Drive or a Two Phase-Single Ended Drive, for example Fairchild's type NDSSS58H.

There are many versions of electronic controlling device with different protection schemes available, however they all perform essentially the same control function. The Full Bridge Drive has a few advantages over the Single Ended Drive as can be seen in the following comparison table.

| Items for Comparison | Full Bridge Drive | Two Phase Single End Drive |
|---|---|---|
| Stator Boards coil resistance seen by Motor Controller | Equals the sum of all individual stator coils | Equals ½ the sum of all individual stator coils |
| Motor Magnetic Drive Operation | Push and Pull | Either Push or Pull |
| Motor efficiency | More efficient than Two Phase Single End Drive | Less efficient than Full Bridge Drive |
| Duty Cycle on Stator Board Coils | 100% | 50% |
| Electrical Attachment Points to Each Stator Board | 2 | 3 |
| Stator Board Construction | Requires 1 VIA for each Stator Coil | Requires 2 VIA'S for each stator Coil |

Using the Two Phase-Single Ended Drive as the controlling device 28 requires a differently designed stator 14 of the magnetic drive 6 and stator plate 20 and 20A of the electric motor 7. Coils 21 on the circuits boards 22 of stator plates 20 and 20A and coils windings 16 on the circuits boards 22 of stator 14 (FIG. 8) are arranged in a circular pattern, in a plane perpendicular to an axis of rotation, symmetrically located around an axle 3 that coincides with the axis of the device. Half of one of said coils 21 and coils windings 16 aligns symmetrically with the internal via 29 (a via is a copper plated through hole on a printed circuit board 22 which has two or more layers of copper; it servers as a means of electrically connecting pads or traces of different layers together on the circuit board 22) connecting the other half coils 21 and coils windings 16 on the opposite side of on the circuits boards 22 while maintaining the same turn directions. This single coil 21 and coils winding 16 is then series connected with the adjacent coils 21 and coils winding 16, correspondingly, in a manner to yield the opposite magnetic polarity. All coils 21 and coils windings 16 on the circuits boards 22 form a continuous series connection of coils 21 and coils windings 16 with every adjacent coil 21 and coils winding 16, correspondingly, having the same turn direction.

Figure 8:
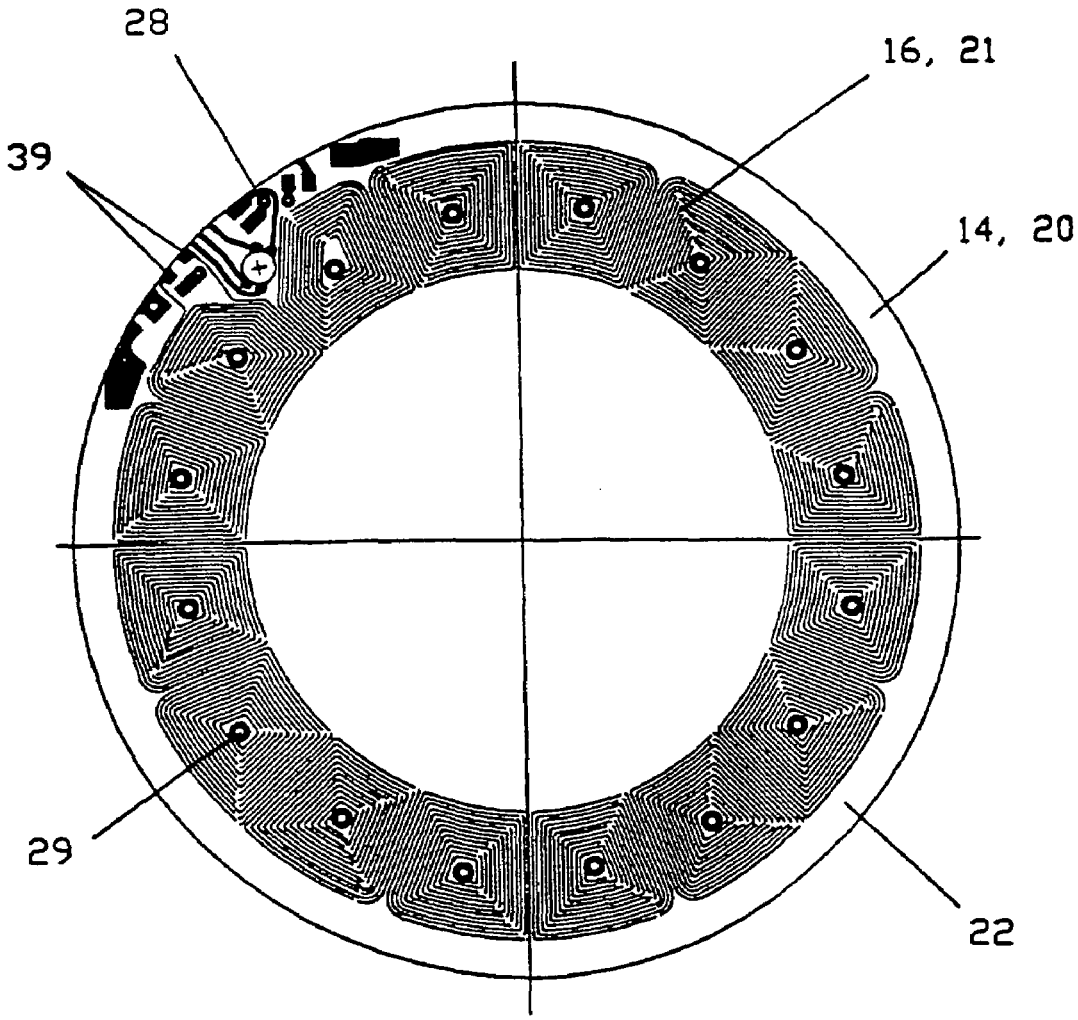
FIG. 8 is a plan view of the stator plate with the coils and of the stator with coils winding, correspondingly.

Each adjacent coil 21 and coils winding 16 has the opposite magnetic polarity at any one point in time. FIG. 8 illustrates a front side of the circuit board 22 that contains coils 21 or coils windings 16 etched from metal, usually copper, on a circuit board substrate and located around the circumference of the circuit board 22. In FIG. 8 one of the coils 21 or coils windings 16 is interrupted (broken) for providing power leads 39 to the controlling device 28 placed on one of the stators or stator plates. The two power leads 39 from each of the circuit board 22 can be connected parallel or series to one another.

Figure 9:
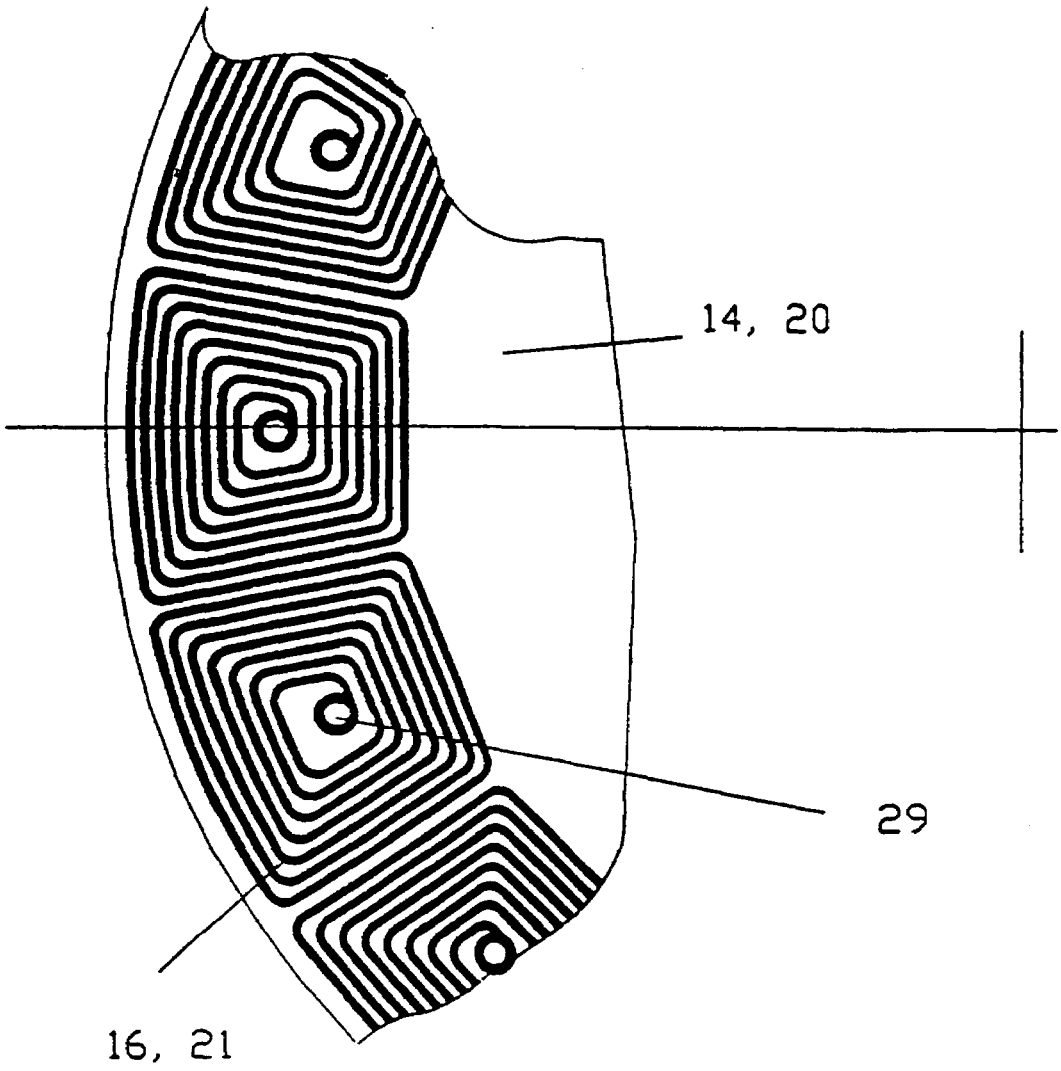
FIG. 9 is an enlarge section of the front and FIG. 9A is an enlarge section of the back (transparent) of the stator plate and the stator, correspondingly, to FIG. 8.
Figure 9A:
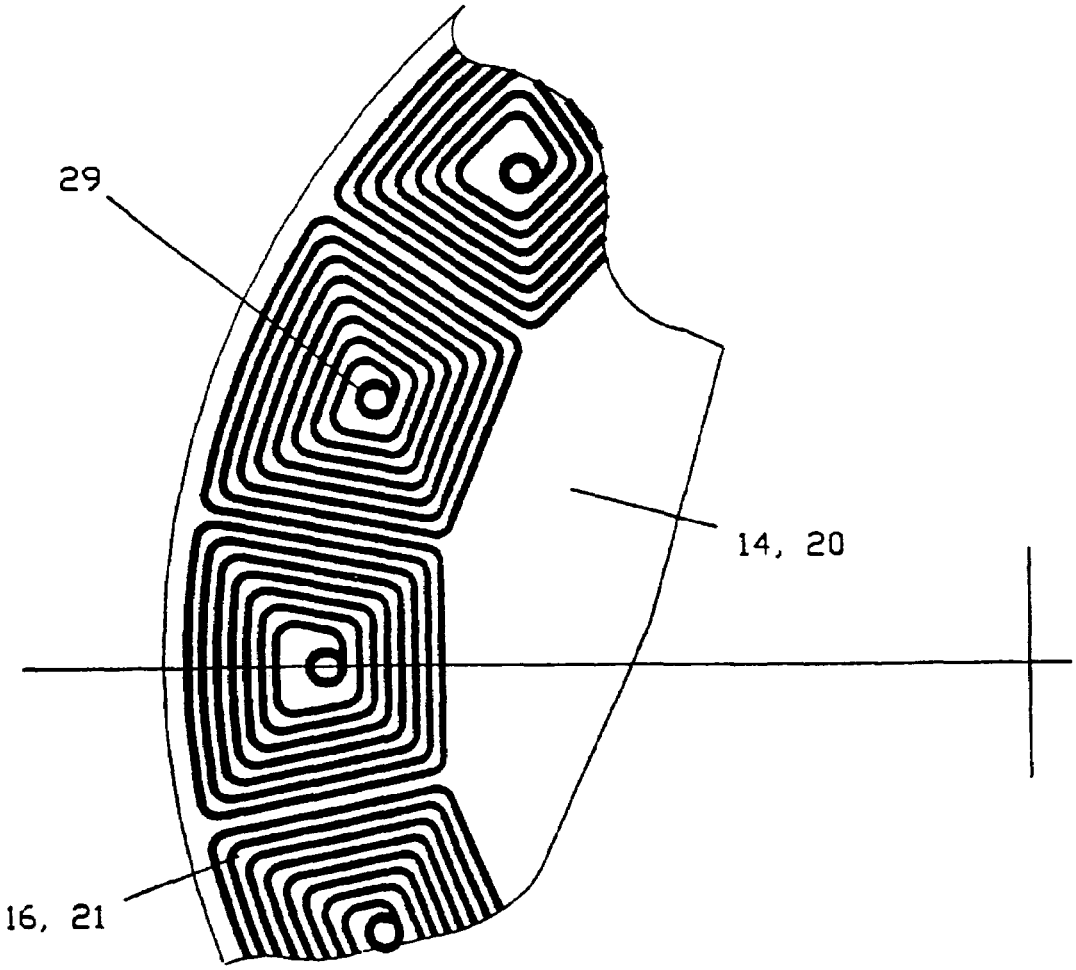

FIG. 9 illustrates an enlarge section of the front side and FIG. 9A illustrates an enlarge section of the backside (transparent) of the circuit board 22 on FIG. 8. A set of coils 21 and 21*a* or coil windings 16 and 16*a* are formed on each side of the circuit board 22. Each of these sets comprises several pairs of coils or coils windings and each pair made as a spiral. In FIG. 9 the spiral extends from the center of the start coils or coils windings to the center of the end coil or coils windings, correspondingly, with the same turn direction of the spiral in relation to the both centers. Both layers of coils 21 and 21*a* or coils windings 16 and 16*a* are the same in the transparent view and shifted angularly in such a way that the center of the start coil or coils winding from one side of the circuit board 22 is electrically connected through circuit board 22 by internal via's 29, which are copper plated holes, with the center of the other side of the circuit board 22, correspondingly. Coil 21*a* or coils winding 16*a* is connected in the same fashion as coil 21 or coils winding 16, correspondingly, on the front side of the circuit board 22. All coils 21 and 21 and coils winding 16 and 16*a* around the circuit board 22 are interconnected in this fashion creating a continuous series of coils and coils windings. These coils and coils windings can be nickel gold plated which allows the magnetic means 13 on the rotor 19 and magnetized poles 17 to align with them for proper startups (Nickel is ferromagnetic at temperatures below 627 degrees Kelvin).

The series connection is broken between two of the adjacent coils 21 and coils windings 16, on each on the stator plates 20 and stator 14 for electrical leads attachment 39. The two leads 39 from each of the on the stator 14 and stator plates 20 can be connected in parallel to each other or series. The connections must be phased to generate proper magnetic fields on the stator 14 and stator plates 20 relative to the rotor 19. The face of each of the stator 14 and stator plates 20 facing the rotor 19 is polarized such that the coils 21 and coils windings 16 aligning directly across each magnetized pole 17 has opposite polarities from each other at any one point in time. If connected in series, the remaining lead from each of the stator 14 and stator plates 20 will be attached to the Full Bridge Motor Driver. If connected in parallel, each of the two connected leads will be attached to the Full Bridge Motor Driver (the controlling device 28). Monitoring of a rotor's 19 position for commutation of the electric motor 7 and the magnetic drives 6 are accomplished by means of a hall device sensing only a position of the rotor 19 of electric motor 7.

Figure 6:
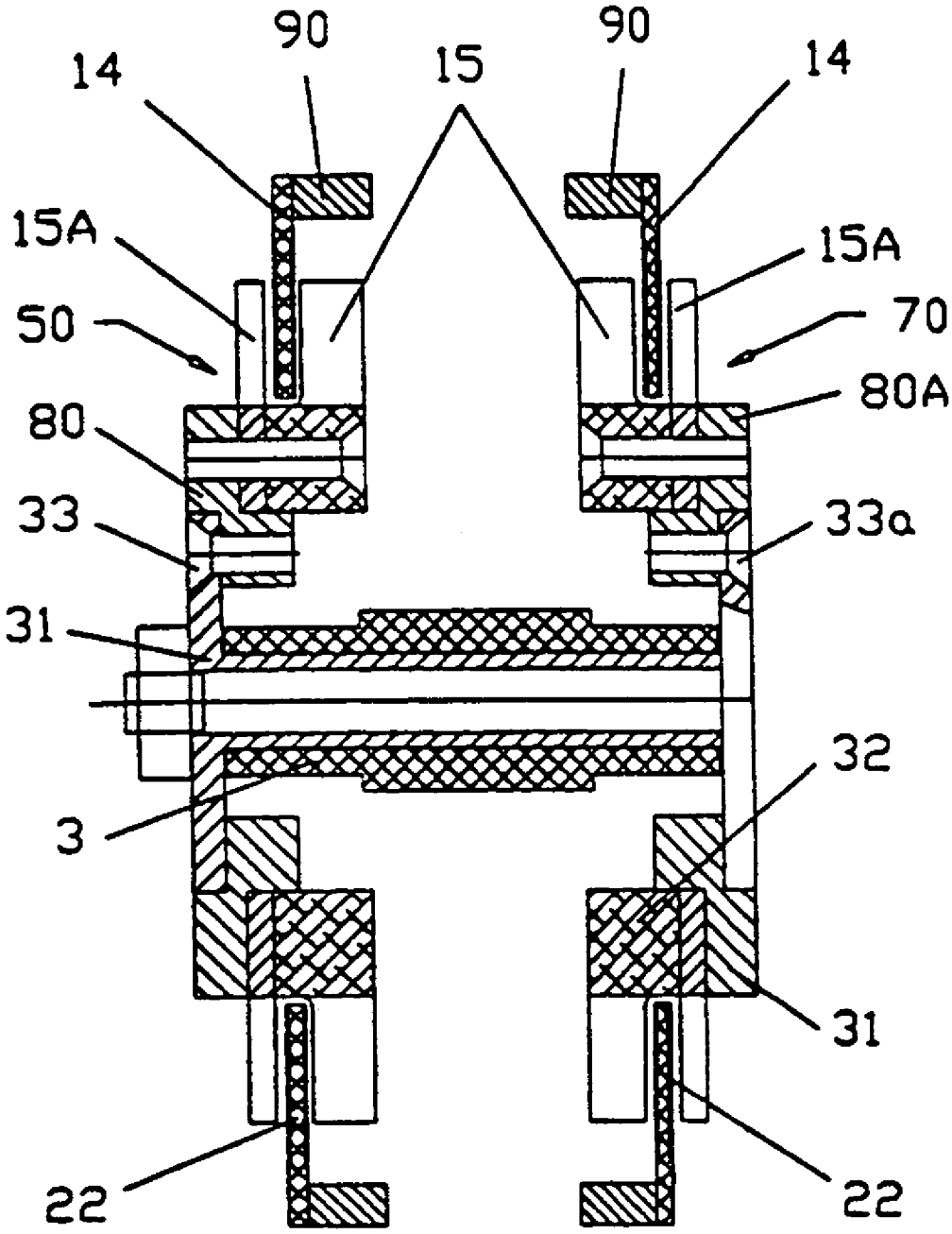
FIG. 6 is an axial sectional view showing two magnetic drives separated from the integrated motorized pump (without ended ferrous metal plates)

FIG. 6 illustrates two identical magnetic drives 6 as outer parts of the integrated motorized pump 1 separated from the inner electric motor 7. Each magnetic drive 50 and 70 each comprises magnetized disks 15 and 15A that may be fabricated by conventional technologies, for example, by molding from a permanent magnet material in conjunction with a hub 32. The magnetic drives 50 and 70 are mechanically adjoined by means of a common shaft 31 placed in the inside opening of the axle 3. The common shaft 31 on the left magnetic drive 50 is hollow and on the right, magnetic drive 70 made as a bolt, placed inside of the shaft 31, that secures and interlocks both magnetic drives 50 and 70. The left magnetic drive 50 is secured to the common shaft 31 by recessed flange 80 by means of locking screws 33. The right magnetic drive 70 is attached to the common shaft 31 in the same fashion 80A using locking screws 33A. The common shaft 31 slides into the opening of axle 3 and forms a rigid spool locking two magnetic drives 50 and 70 together and allows the free rotation inside the axle 3. The axle 3, also serves as part of the bearing for the electric motor 7 as well as the magnetic drives 6. Stator 14 of the magnetic drives 6 are secured on the outer edges to the casing 8 by stator frames 90.

Figure 3:
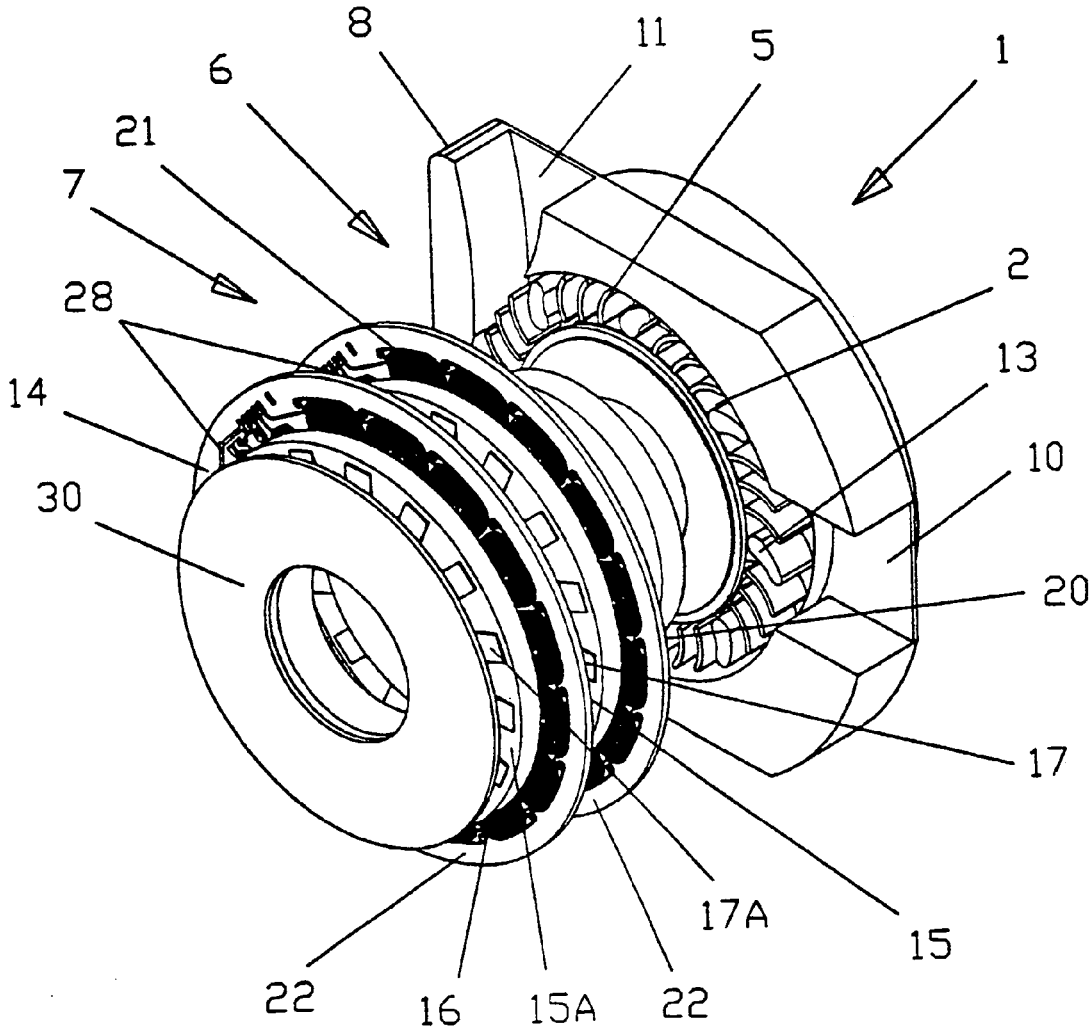
FIG. 3 is a partially exploded perspective view showing the integrated motorized pump according to present invention when a pump is a cross flow type pump.
Figure 11:
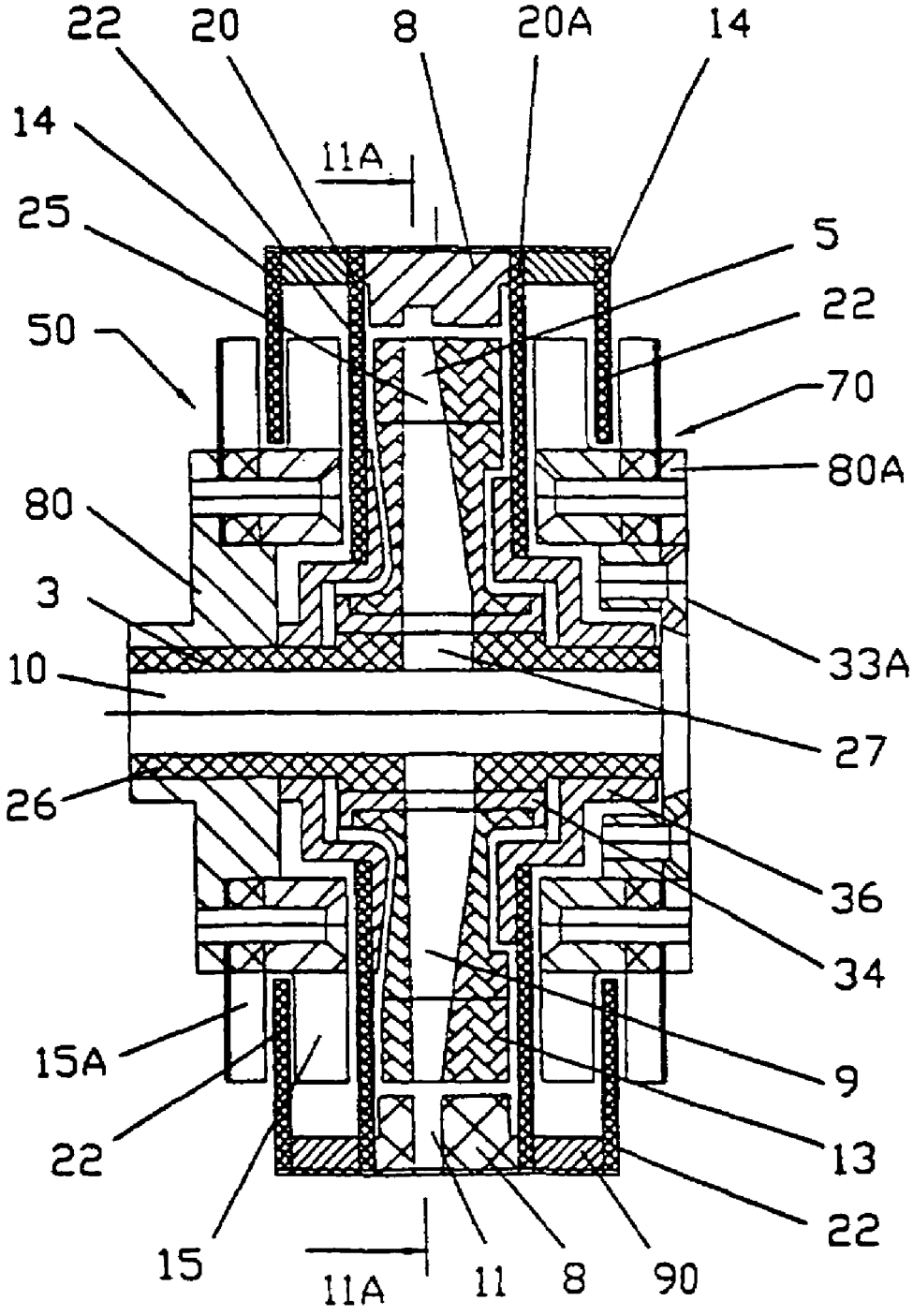
FIG. 11 is an axial cross sectional view showing a sample of design of the integrated motorized pump according to present invention when a pump is a centrifugal type pump.

The magnetic drive 6 FIGS. 3, 11 further has at least one ended ferrous metal plate 30 that is mounted opposite said magnetic drive 6 to the electric motor 7 for strengthening and alignment of said flux lines in direction to the magnetized disks 15, 15A.

Figure 4:
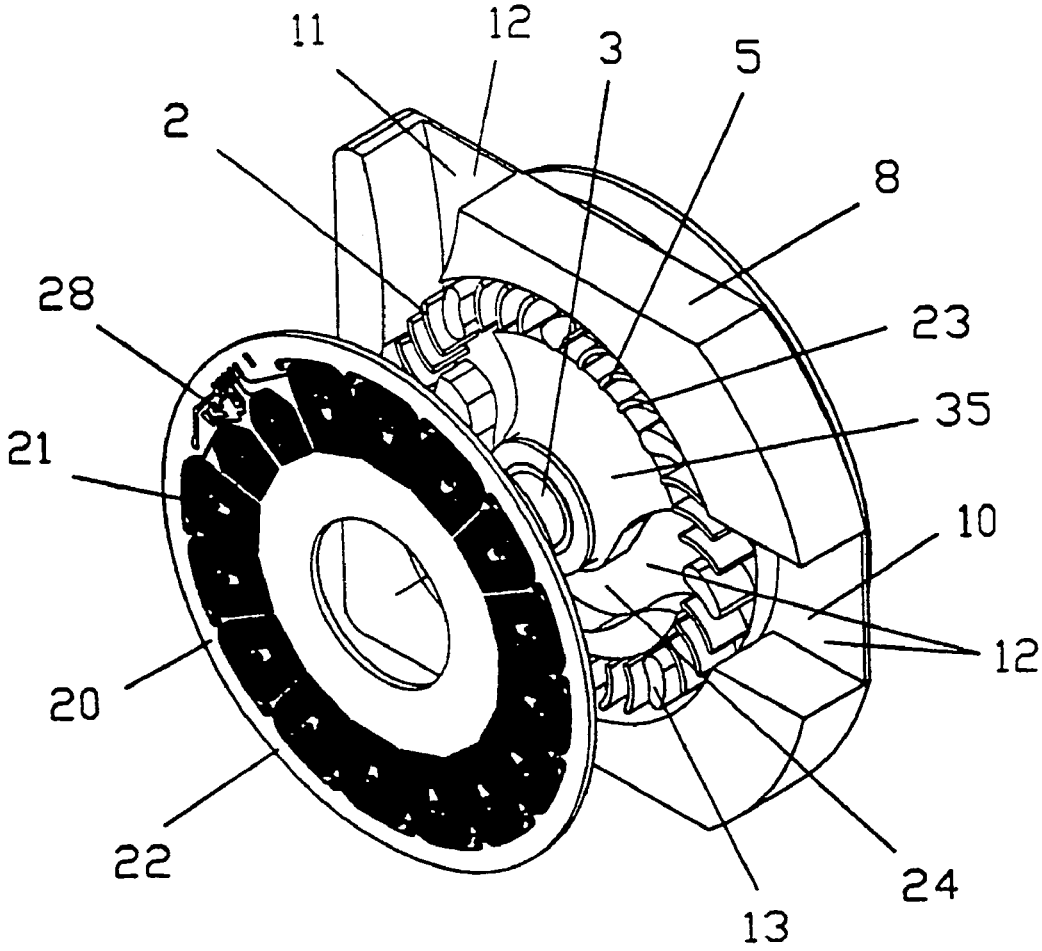
FIG. 4 is partially exploded perspective view showing the electric motor comprises the impeller as a rotor and the stator plate.
Figure 5:
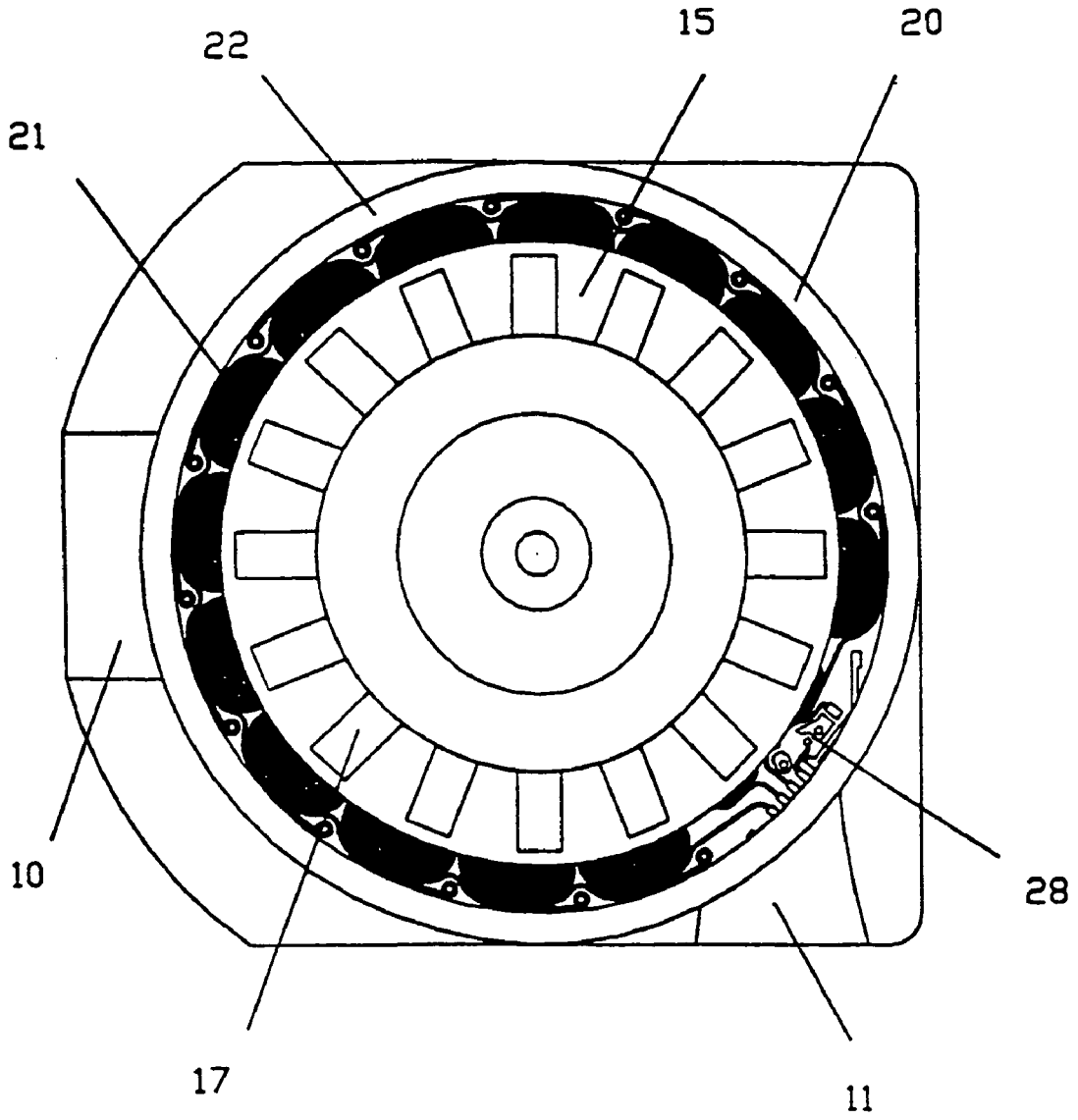
FIG. 5 is a side view along an arrow V of FIG. 1A.
Figure 7:
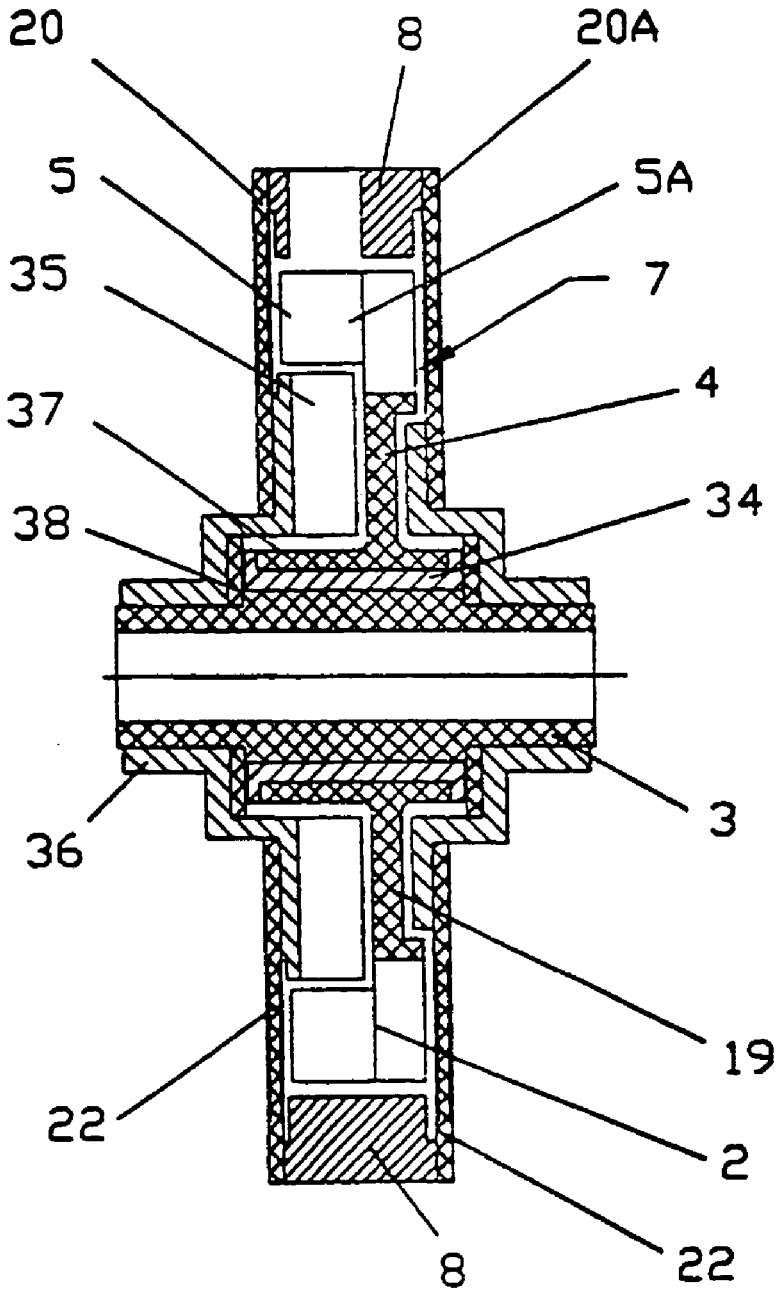
FIG. 7 is an axial sectional view showing the electric motor, separated from the integrated motorized pump, comprises the impeller as a rotor and two stator plates.

FIGS. 4 and 7 illustrates the electric motor 7 as an inner part of the integrated motorized pump 1 and separated from the magnetic drives 6. The inner electric motor 7 located inside the casing 8 with a flowing space 9 and inlet and outlet channels 10, 11. The impeller 2 is placed inside the flowing space 9 and along with the flowing space 9, inlet and outlet channels 10 and 11 forms pump flowing part 12.

The electric motor 7 has two stator plates 20 and 20A are permanently attached to the casing 8, axle 3 and are covered from the rotor 19 side with a liquid tight coating with a plastic material to ensure a fluid seal and protect their coils 21 from the fluids within the pump flowing part 12. Stator plates 20 and 20A are joined at the outer edges of the casing 8 and frames 90. The rotor 19 of the electric motors 7 is fashioned in the shape of the drum type impeller 2 that includes impeller disk 4 and blades 5 attached to that impeller disk 4. The impeller disk 4 with blades 5 is placed between two parallel stator plates 20, 20A and separated from them by a fixed distance. Some of the blades 5 and impeller disk 4 are made from magnetic plastic material or some other permanent magnet material and serve as magnetized means 13. Blades 5 and impeller disk 4 are magnetized in the direction parallel to the axle 3. This allows the edges of blades 5 adjacent to one of the stator plates 20, to have the opposite magnetic polarity as the edges of some blades 5 adjacent to the other stator plate 20A. The number of blades 5 of the rotor 19 is divisible in respect to the number of coils 21 on the stator plates 20. It is possible to have some blades 5A magnetized in the direction parallel to the axle 3, or parts of the impeller disk 4 magnetized in the same direction. The number of coils 21 depends on how many electrical phases the electric motor 7 will have. All figures of the preferred embodiment represent a single-phase drive, full bridge configuration. The axle 3 may be hermetically secured with the casing 8 and the stator plates 20, so the pump flowing part 12 became sealless.

The magnetic drives 6 as an outer part and the electric motor 7 as an inner part of the integrated motorized pump 1 additionally coupled electro magnetically by means of that the stator plates 20, 20A of the electric motor 7 serve as stator 14 for the magnetic drives 6, in other words electric motor 7 and magnetic drives 6 have common stator parts. The magnetized disks 15 and 15A of the magnetic drives 6 are mounted on the axle 3 perpendicularly to the axle 3 and have a circumferential array of radially extending magnetized poles 17. But it is possible to have separate stator plates and stators for electric motor 7 and magnetic drive 6. The magnetized poles 17 are spaced axially from the magnetic means 13 of the impeller 2 to form a gap 18, and magnetized poles 17 of the magnetized disk 15 are magnetically opposite to the magnetic means 13 of the impeller, such that the flux lines of the magnetized N poles 17 of the magnetized disk 15 extends to S poles of the magnetic means 13 of the impeller 2 in the shortest axial flux dimension across the gap 18.

The integrated motorized pump 1 on FIGS. 1-7 is a cross flow type pump with impeller 2 that is a drum type impeller 23. The flowing space 9 comprises one internal channel 24 located inside of an array of the blades 5. Directional vanes 35 that are rigidly secured with the axle 3 by bushing 36 to form the internal channel 24. The internal channel 24 enhances the performance of the cross flow type pump.

The internal channel 24, the inlet and outlet channels 10 and 11 are spaced at a plane perpendicular to the axle 3, so as liquid flows through the inlet channel 10, the blades 5 of the impeller 2, the internal channel 24, the blades 5 of impeller 2 again and the outlet channel 11 in a series way.

The impeller 2 of the electric motor 7 has a hard steel insert 37 that might be permanently attached during the impeller molding process. (It is possible to produce the impeller 2 in other conventional manners). This hard steel insert 37 serves as part of the bearing 34. The liquid that moved through the pump flowing part 12 serves as the lubricant for the bearing 34 formed by these two surfaces. Located on each side of the rotor are washers 38 that decreasing the friction of the rotor 19.

The total motor torque is achieved by the combined magnetic and electro magnetic forces generated by two magnetic drives 6 and electric motor 7. Each of two magnetic drives 6 includes a stator 14 made as a circuit board 22 with printed coils windings 16 and two magnetized disks 15, 15A with alternative magnetized poles 17, and 17A. The magnetized poles 17, 17A magnetically interact from the both sides with the magnetic blades 5 of the impeller 2. Simultaneously magnetic poles 17, 17A and magnetic blades 5 are interacting with stator plate 20, 20A from the both sides of the each stator plate 20, and 20A. The magnetic flux path of the magnetized poles 17, 17A and magnetic blades 5 is through the entire motor rotor and stator assembly. The coils windings 16 along with coils 21 of the stators 14 and stator plates 20 are energized in a fashion to create a rotating magnetic field around the axle 3 and in turn causing the magnetic drives 6 and electric motor 7 to rotate. The inner impeller 2 is locked in sync with the outer magnetic drives 6 by the strong magnetic fields generated by the coil windings 16 and coils 21 in conjunction with the magnetized poles 17, 17A and magnetized blades 5. This allows for impeller 2 rotations with the required torque to move fluids against moderate head pressures.

Figure 10:
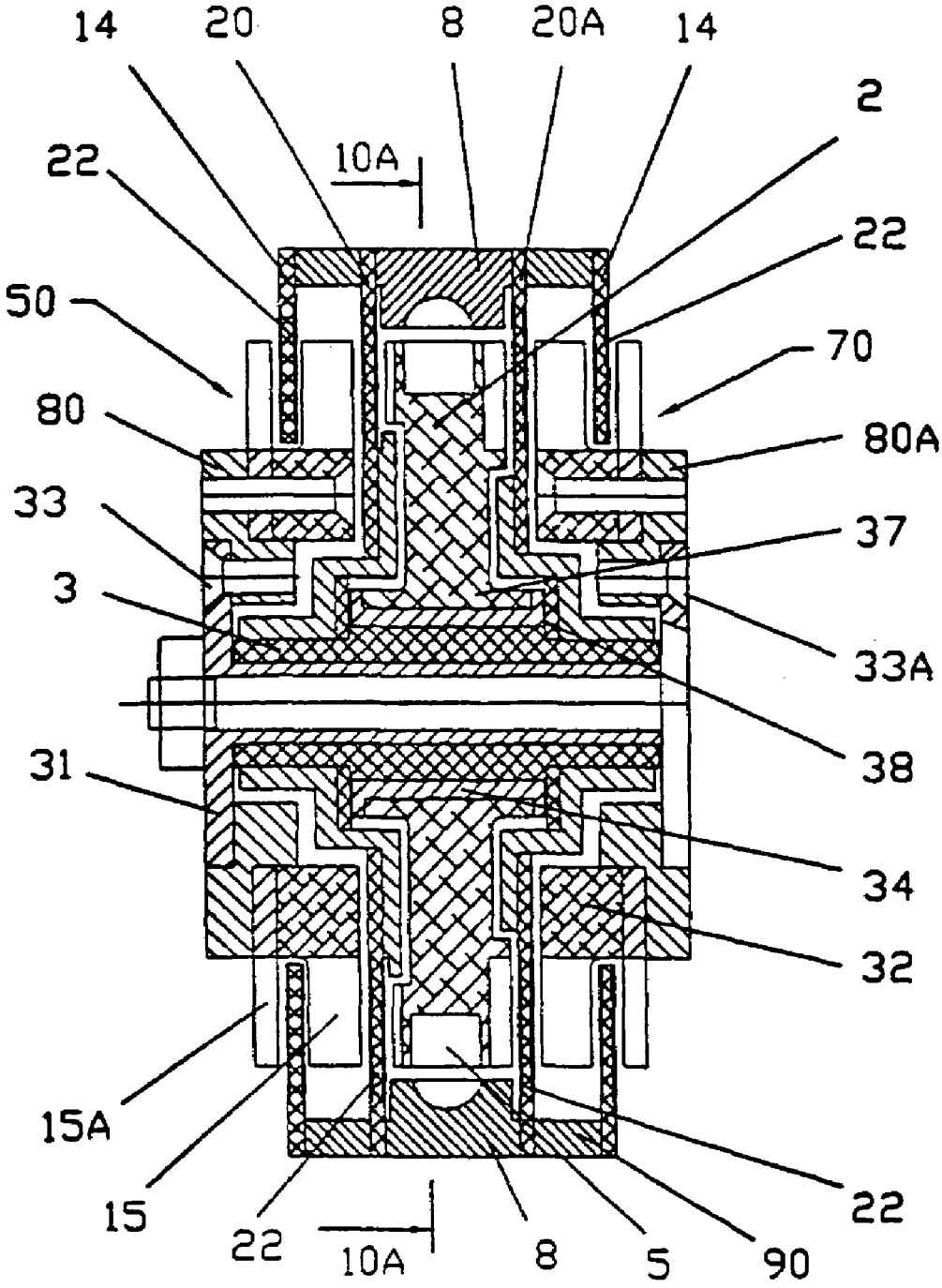
FIG. 10 is an axial cross sectional view showing a sample of design of the integrated motorized pump according to present invention when a pump is a peripheral type pump.
Figure 10A:
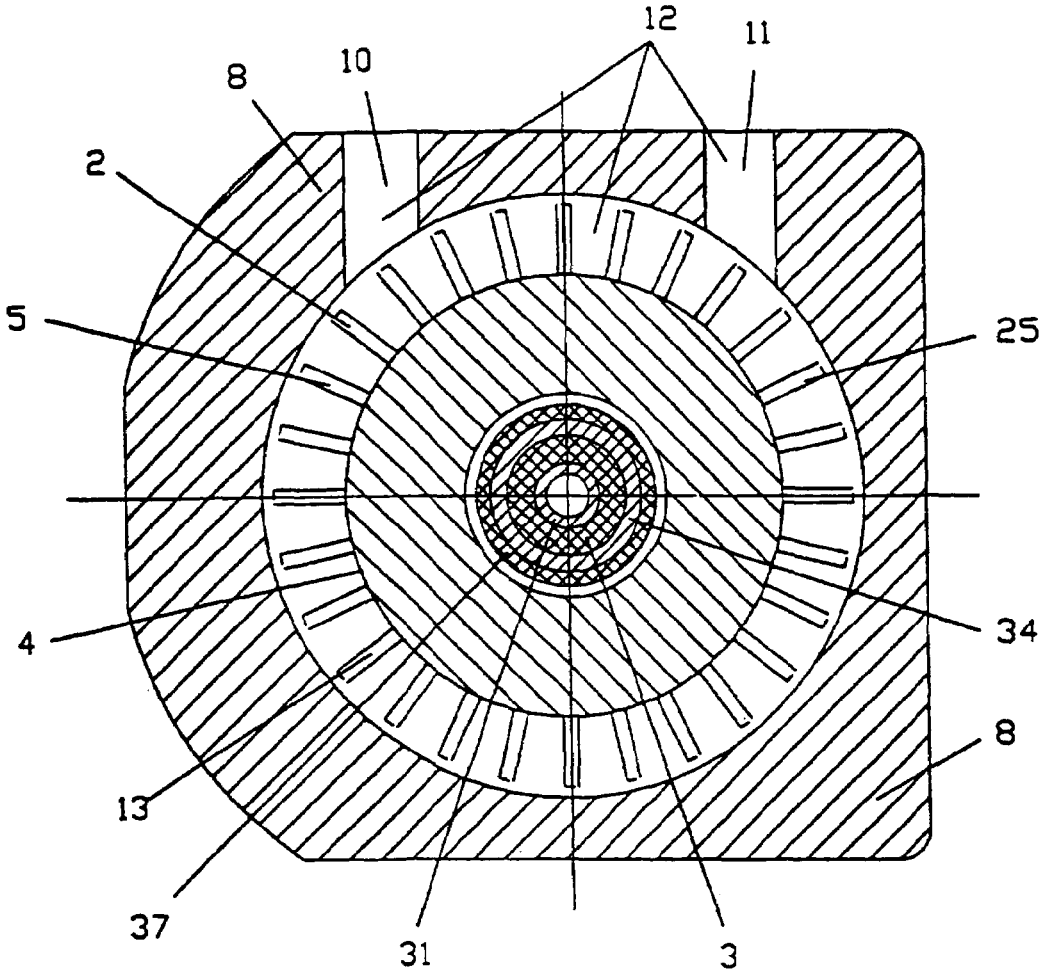
FIG. 10A is a cross sectional view along section 10A-10A of FIG. 10.

FIGS. 10 and 10A illustrate another variant of the present invention differ from the preferred embodiment in using a peripheral type pump. The impeller 2 in this peripheral type pump is a radial type impeller 25 with the blades 5 that are attached to end surface of the impeller disk 4. The impeller 2, the inlet and outlet channels 10 and 11 are spaced at a plane perpendicular to the axle 3, so as liquid flows through the inlet channel 10, circumferentially with said impeller 25 and through the outlet channel 11 in a series way. All other parts are the same as in preferred embodiment and their description will be omitted.

Figure 11A:
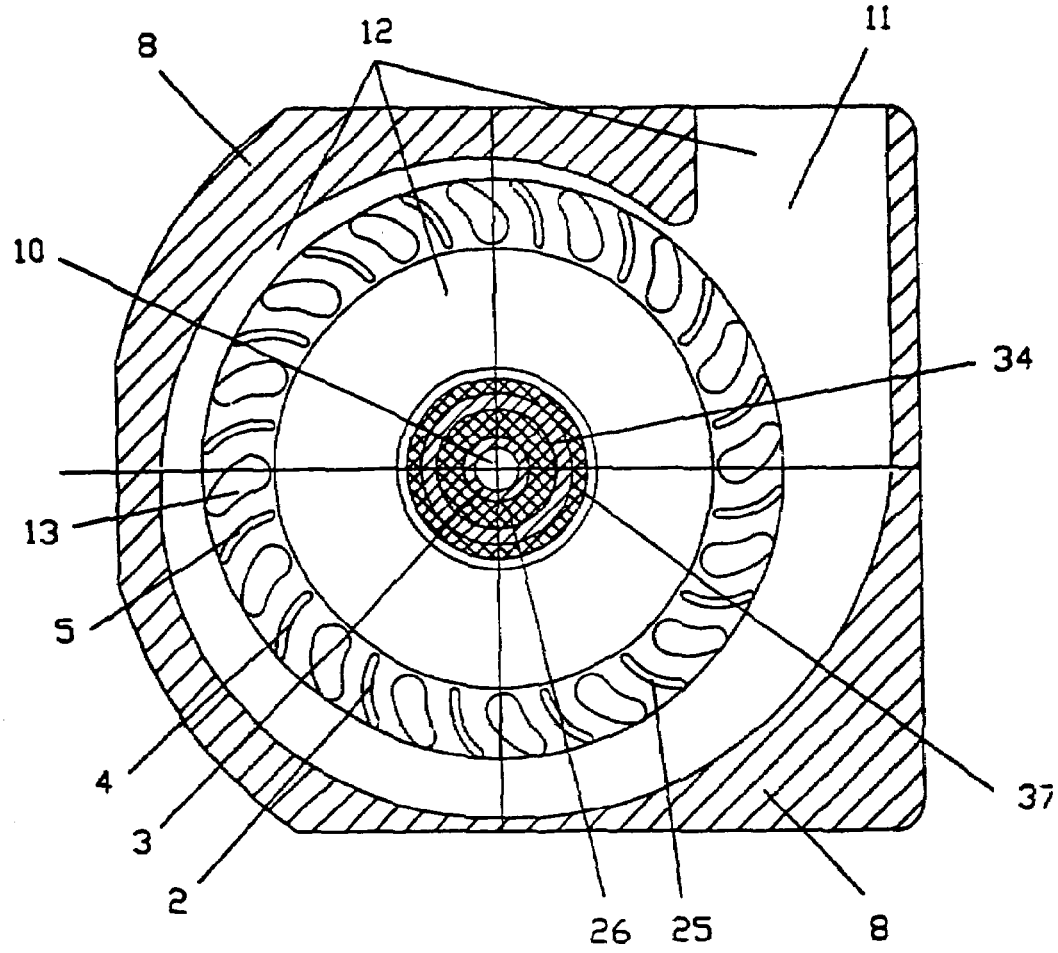
FIG. 11A is a cross sectional view along section 11A-11A of FIG. 11.

FIGS. 11 and 11A illustrate a third embodiment of the present invention differing from the first embodiment in using a centrifugal type pump. The impeller 2 in the third embodiment is a radial type impeller 25, and the axle 3 is made like a blind hollow cylinder 26. The blind hollow cylinder 26 is served as inlet channel 10 and comprises exit ports 27 through a lateral surface of the blind hollow cylinder 26, so as liquid flows through the inlet channel 10, the blind hollow cylinder 26, the exit ports 27, the blades 5 of said impeller 25 and the outlet channel 11 in a series way. All other parts are the same as in first embodiment and their description will be omitted.

While various embodiments have been shown, it should also be obvious to those having ordinary skill in the art that there are still further variations in the number of parts of the magnetic drives, magnetic means, magnetized disks and other features of the invention which while not disclose, are encompassed within the spirit of the invention.

What is claimed is:

1. An integrated motorized pump, comprising:

(i) an impeller that is mounted on an axle and comprising at least one impeller disk and blades attached to said at least one impeller disk, at least one magnetic drive electro magnetically coupled with an electric motor, and a casing with a flowing space and inlet and outlet channels, wherein:

(ii) said impeller being placed inside said flowing space and along with said flowing space, inlet and outlet channels forms pump flowing part;

(iii) said impeller having circumferential arrayed magnetic means magnetized in the direction parallel to said axle;

(iv) said magnetic drive comprising at least one stator and at least one magnetized disk, wherein:

(v) said stator comprising circumferential arrayed coil windings, and said magnetized disk is mounted on said axle and having a circumferential array of radially extending magnetized poles and being mounted perpendicularly to the axle, said magnetized poles of said magnetized disk being spaced axially from the magnetic means of said impeller to form a gap, and at least part of said magnetized poles of said magnetized disk being magnetically opposite to the magnetic means of the impeller, such that the flux lines of the magnetized N poles of said magnetized disk extends to S poles of the magnetic means of the impeller in the shortest axial flux dimension across said gap;

(vi) said electric motor comprising said impeller as a rotor, and at least one stator plate;

(vii) said stator plate being covered with a liquid tight coating and comprising circumferential arrayed coils etched on circuit board metal layers and said coils being at least partially positioned within said gap between said magnetized disk and said magnetic means, and the number of said coils is divisible in respect to the number of said magnetic means and said magnetized poles;

(viii) said casing is rigidly secured with said axle and said stator plate.

2. The integrated motorized pump according to claim 1, wherein said impeller is a drum type impeller, said flowing space comprising at least one internal channel located inside an array of said blades, said internal channel, said inlet and outlet channels being spaced at a plane perpendicular to said axle, so as liquid flows through the inlet channel, the blades of said impeller, the internal channel, the blades of impeller again and the outlet channel in a series way, so that said integrated motorized pump is a cross flow type pump.

3. The integrated motorized pump according to claim 1, wherein said impeller is a radial type impeller, said axle being made like a blind hollow cylinder, said blind hollow cylinder being served like inlet channel and comprising exit ports through a lateral surface of said blind hollow cylinder, so as liquid flows through the inlet channel, the blind hollow cylinder, the exit ports, the blades of said impeller and the outlet channel in a series way, so that said integrated motorized pump is a centrifugal type pump.

4. The integrated motorized pump according to claim 1, wherein said impeller is a radial type impeller with the blades being attached to end surface of the impeller disk, said impeller, said inlet and outlet channels are spaced at a plane perpendicular to said axle, so as liquid flows through the inlet channel, circumferentially with said impeller and through the outlet channel in a series way, so that said integrated motorized pump is a peripheral type pump.

5. The integrated motorized pump according to claim 1, wherein said axle is hermetically secured with said casing and said stator plates, so said pump flowing part is sealless.

6. The integrated motorized pump according to claim 1, wherein said magnetic means are at least part of said impeller disk.

7. The integrated motorized pump according to claim 1, wherein said magnetic means are at least part of said blades.

8. The integrated motorized pump according to claim 1, wherein said magnetic means are at least part of every said blades.

9. The integrated motorized pump according to claim 1, wherein said coil windings and coils are plated with ferromagnetic coating material.

10. The integrated motorized pump according to claim 9, wherein said ferromagnetic coating material is nickel.

11. The integrated motorized pump according to claim 1, wherein said coil windings etched on circuit board metal layers.

12. The integrated motorized pump according to claim 1, wherein said circuit board metal layers are copper layers.

13. The integrated motorized pump according to claim 1, wherein said stator further comprising a controlling device of a type H-bridge drive, and a single layer of coil windings located on each side of the circuit board, where each said layer comprises several pairs of coil windings and each pair is made as a spiral that extends from the center of a start coil winding to a center of an end coil winding with the same turn direction of the spiral in relation to each coils center; said layers of coil windings are the same in transparent view and shifted angularly in such a way that the center of the start coil windings from one side of the board are electrically connected through the circuit board by internal via's, which are copper plated holes, with the center of the end coil windings on the other side of the board; the circuit of said one layer of coil windings is interrupted (broken) for providing power leads to the said controlling device.

14. The integrated motorized pump according to claim 1, wherein said stator plate further comprising a controlling device of a type H-bridge drive, and a single layer of coils located on each side of the circuit board, where each said layer comprises several pairs of coils and each pair is made as a spiral that extends from the center of a start coil to a center of an end coil with the same turn direction of the spiral in relation to each coils center; said layers of coils are the same in transparent view and shifted angularly in such a way that the center of the start coils from one side of the board are electrically connected through the circuit board by internal via's, which are copper plated holes, with the center of the end coils on the other side of the board; the circuit of said one layer of coils is interrupted (broken) for providing power leads to the said controlling device.

15. The integrated motorized pump according to claim 1, wherein the magnetic drive comprising two said magnetized disks and one stator located between said magnetized disks, and wherein each magnetized disk is mounted on said axle and having a circumferential array of radially extending magnetized poles and being mounted perpendicularly to the axle, said magnetized poles of one magnetized disk being spaced axially from the magnetized poles of other magnetized disk to form a gap, and said magnetized poles of one magnetized disk being magnetically opposite to the magnetized poles of other magnetized disk, such that the flux lines of the magnetized N poles of one magnetized disk extends to S poles of other magnetized disk in the shortest axial flux dimension across said gap.

16. The integrated motorized pump according to claim 1, comprising two magnetic drives, wherein the electric motor comprising two stator plates and the impeller placed between said two stator plates, and wherein each of said two magnetic drives located outside on each side of the electric motor on the said axle.

17. The integrated motorized pump according to claim 16, wherein at least one stator plate of said electric motor serves as the stator of the magnetic drive.

18. The integrated motorized pump according to claim 1, wherein the stator plate of said electric motor serves as the stator of the magnetic drive.

19. The integrated motorized pump according to claim 1, wherein said magnetic drive further having at least one ended ferrous metal plate that is mounted opposite said magnetic drive to said electric motor on said axle for strengthening and alignment of said flux lines in direction to said magnetized disk.

20. The integrated motorized pump according to claim 16, wherein said both magnetic drives secured on a common shaft placed in the inside opening of the said axle.

21. The integrated motorized pump according to claim 20, wherein said common shaft at first said magnetic drive is hollow and said common shaft at second said magnetic drive made as a bolt that secures and interlocks both said magnetic drives.

* * * * *